US005827403A

United States Patent [19]

Boswell et al.

[11] Patent Number: 5,827,403

[45] Date of Patent: Oct. 27, 1998

[54] METHOD OF DESIGNING AND MANUFACTURING A DELAYED COKER DRUM

[75] Inventors: Richard S. Boswell, Magnolia, Tex.; Thomas D. Farraro, Lake Charles, La.

[73] Assignee: Citgo Petroleum Corporation, Tulsa, Okla.

[21] Appl. No.: 677,801

[22] Filed: Jul. 10, 1996

[51] Int. Cl.[6] ..... C10B 29/04; C10B 39/00; C10B 13/00

[52] U.S. Cl. ..... 202/268; 202/227; 202/267.1; 201/17; 201/39

[58] Field of Search ..... 202/227, 267.1, 202/268; 201/17, 39

[56] References Cited

U.S. PATENT DOCUMENTS

| | | | |
|---|---|---|---|
| 1,065,081 | 6/1913 | Reubold . | |
| 3,611,787 | 10/1971 | D'Annessa et al. | 73/15.6 |
| 3,780,888 | 12/1973 | Hoffman | 214/18 K |
| 3,917,516 | 11/1975 | Waldmann et al. | 202/227 |
| 3,936,358 | 2/1976 | Little | 201/39 |
| 4,135,986 | 1/1979 | Cain et al. | 202/227 |
| 4,147,594 | 4/1979 | Cain et al. | 201/39 |
| 4,282,068 | 8/1981 | Flockenhaus et al. | 202/227 |
| 4,284,478 | 8/1981 | Brommel | 202/227 |
| 4,285,772 | 8/1981 | Kress | 201/39 |
| 4,289,585 | 9/1981 | Wagener et al. | 202/227 |
| 4,294,663 | 10/1981 | Tennyson | 201/39 |
| 4,312,711 | 1/1982 | Brown et al. | 202/227 |
| 4,344,822 | 8/1982 | Schwartz et al. | 201/39 |
| 4,358,343 | 11/1982 | Goedde et al. | 201/1 |
| 4,396,461 | 8/1983 | Neubaum et al. | 201/39 |
| 4,409,067 | 10/1983 | Smith | 201/1 |
| 4,437,936 | 3/1984 | Jung | 201/39 |
| 4,469,557 | 9/1984 | Schweer et al. | 201/17 |
| 4,512,850 | 4/1985 | Mosebach | 201/1 |
| 4,557,804 | 12/1985 | Baumgartner et al. | 202/227 |
| 4,588,479 | 5/1986 | Weber et al. | 202/228 |
| 4,614,567 | 9/1986 | Stahlherm et al. | 201/1 |
| 4,634,500 | 1/1987 | Elliott et al. | 201/39 |
| 4,644,750 | 2/1987 | Lockett et al. | 60/641.2 |
| 4,726,465 | 2/1988 | Kwasnik et al. | 202/230 |
| 4,743,342 | 5/1988 | Pollert et al. | 202/227 |
| 4,747,913 | 5/1988 | Gerstenkorn et al. | 202/227 |
| 4,772,360 | 9/1988 | Beckmann et al. | 202/227 |
| 4,802,573 | 2/1989 | Holter et al. | 201/39 |
| 4,832,795 | 5/1989 | Lorenz et al. | 202/228 |
| 4,886,580 | 12/1989 | Kress et al. | 202/228 |
| 4,997,527 | 3/1991 | Kress et al. | 201/39 |
| 5,024,730 | 6/1991 | Colvert | 196/132 |

FOREIGN PATENT DOCUMENTS 0 209 285 A 1/1987 European Pat. Off. .

*Primary Examiner*—Tae Yoon
*Attorney, Agent, or Firm*—Head, Johnson & Kachigian

[57] ABSTRACT

A method of manufacturing a delayed coker drum as used in a refining process to receive coke feedstock as a hot liquid and in which the coke feedstock is cooled and quenched to produce solid coke, the hot liquid causing the drum to initially expand circumferentially and laterally and upon quenching to shrink due to thermal contraction, the circumferential shrinking serving to crush solidified coke and the lateral shrinking causing interface frictional contact between the solidified coke and the vessel sidewall that must be overcome, inducing high level stresses in the drum, including the steps of selecting a plurality of metal plates configured for assembling the drum, and welding the plates together creating welded seams and in which the metal plates are selected to have metallurgical characteristics and thicknesses such that their elastic limits exceed the stress introduced in the plates during the quenching process and employing welding materials and techniques such that the elastic limits of the welded seams exceed the stress introduced in the seams as the drum shrinks circumferentially and laterally during quenching operations.

9 Claims, 2 Drawing Sheets

METHOD OF DESIGNING AND MANUFACTURING A DELAYED COKER DRUM

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

Petroleum refining operations, in which crude oil is processed to produce gasoline, diesel fuel, lubricants and so forth, always produces residues that are referred to in the trade as "coke". Coke residue, usually termed "coke feedstock" is usually heated in a furnace to cause destructive distillation in which substantially all of the remaining useable hydrocarbon products are driven from the residue, leaving the coke product, essentially carbon, which is conveyed into a coke drum. The typical coke drum is a large, upright, cylindrical, steel walled vessel that may, for example, be in the order of approximately 90–100 feet in height (30.48 meters) and 20–30 feet in diameter (6.10–9.14 meters), although the actual structural size and shape of the coke drum can vary considerably from one installation to another. Delayed coker vessels, usually referred to as "coker drums" or "coke drums" are typically manufactured by welding together patterns of steel plates. Therefore, the characteristics of a coke drum are directly related to the characteristics of the steel plates and welding seams by which the drum is formed.

Typically, a refinery has a plurality of coke drums. The production of coke is a batch process, that is, coke feedstock is deposited as a liquid slurry in a very hot state in a coke drum. The liquid slurry cools and is quenched. After quenched, solid coke is removed from the drum which is then ready for reuse. While coke is being cooled in one or more drums and while the cooled coke is being extracted from one or more drums, other drums are employed to receive the continuous production of coke feedstock as a part of a refining process.

As previously stated, the residue feedstock from a refinery operation is fed through a furnace where destructive distillation occurs. The output of the furnace is a residue that is substantially free of all higher order hydrocarbons. The residue is in the form of a hot vicious liquid product or slurry that is fed into a coke drum at a temperature of about 900° F. (477.4° C.). The hot liquid material fills the drum to approximately 80% of its capacity. Due to the high temperature (about 900° F. as an example) of the liquid product entering the coke drum, the drum thermally expands both longitudinally (laterally) and circumferentially to thereby have a larger internal volume than when the drum is cold. The hot liquid coke enters the drum, typically flowing through an opening in the bottom of the drum and, as the liquid level rises, lays down layers of coke that solidify as the temperature drops. Eventually the coke drum becomes a solid mass with flow channels kept molten by the hot product entering the drum.

When a coke drum is filled to the desired capacity, or during the process of filling, steam is typically introduced into the drum to drive off any remaining hydrocarbon vapors. The drum remains substantially full of coke that, as it cools, hardens into a solid material.

Since the coke, as it passes from a liquid to a solid state is exceedingly hot, and since the coke cannot be discharged from the coke drum as a solid product until it is cooled to substantially ambient temperature, some means must be provided for cooling the coke in the drum otherwise it would take an inordinate length of time for the coke to cool as a result of ambient temperature alone. Consequentially it is a standard procedure to cool coke in a drum by the admission of water, that is, to quench the coke.

When quenching water is introduced, the drum sidewalls shrink both laterally and circumferentially due to thermal contraction of the metal of which the drum sidewalls are formed. As the coke cools, it is transformed from a liquid to a solid phase and the coke drum thermally constricts around the solidified coke to compact and crush the coke. This thermal contraction of the coke drum sidewall, both circumferentially and laterally, is counteracted by a resistance to shrinkage of the solidified coke and by interface frictional resistance between the solidified coke and the drum sidewall as the drum laterally contracts. This counteraction introduces substantial stresses in a coke drum metal sidewall.

Designers and manufacturers of coke drums in the past have not fully understood the nature and magnitude of the stresses to which coke drums are subjected and accordingly coke drums have, in many instances, failed to perform to their maximum useful life expectancies. Stated another way, coke drum failure has been a common and expensive problem for petroleum refinery operators.

It is an object of this invention to provide improved methods of designing and manufacturing coke drums for use in petroleum refineries that have longer and more trouble free lives than coke drums designed and built in the past.

Others have considered the deleterious effects of stress in coke drums and for background information relating to coke drums used in delayed coker processes reference may be had to the following United States patents:

| U.S. Pat. No. | INVENTOR | TITLE |
|---|---|---|
| 1065081 | Reubold | Apparatus For Quenching Coke |
| 3611787 | D'Annessa et al | Apparatus For Minimizing Thermal Gradient In Test Specimens |
| 3780888 | Hoffman | Material Transfer Apparatus For A Rotary Drum |
| 3917516 | Waldmann et al | Coke-Cooling Apparatus |
| 3936358 | Little | Method of Controlling The Feed Rate of Quench Water To A Coking Drum In Response To The Internal Pressure Therein |
| 4135986 | Cain et al | One-Spot Rotary Coke Quenching Car |
| 4147594 | Cain et al | One-Spot Cylindrical Coke Quenching Car and Quenching Method |
| 4282068 | Flockenhaus et al | Apparatus For The Transfer and Quenching of Coke |
| 4284478 | Brommel | Apparatus For Quenching Hot Coke |
| 4285772 | Kress | Method and Apparatus For Handling and Dry Quenching Coke |
| 4289585 | Wagener et al | Method and Apparatus For The Wet Quenching of Coke |
| 4294663 | Tennyson | Method For Operating A Coke Quench Tower Scrubber System |
| 4312711 | Brown et al | Fluid Cooled Quenching Cars |
| 4344822 | Schwartz et al | One-Spot Car Coke |

-continued

| U.S. Pat. No. | INVENTOR | TITLE |
|---|---|---|
| | | Quenching Method |
| 4358343 | Goedde et al | Method For Quenching Coke |
| 4396461 | Neubaum et al | One-Spot Car Coke Quenching Process |
| 4409067 | Smith | Quenching Method and Apparatus |
| 4437936 | Jung | Process For Utilizing Waste Heat and For Obtaining Water Gas During The Cooling of Incandescent Coke |
| 4469557 | Schweer et al | Process For Calcining and Carbonizing Petroleum Coke |
| 4512850 | Mosebach | Process For Wet Quenching Of Coal-Coke |
| 4557804 | Baumgartner et al | Coke Cooler |
| 4588479 | Weber et al | Device For Cooling Incandescent Coke |
| 4614567 | Stahlherm et al | Method and Apparatus For Selective After-Quenching Of Coke On A Coke Bench |
| 4634500 | Elliott et al | Method of Quenching Heated Coke To Limit Coke Drum Stress |
| 4664750 | Biesheuvel et al | Method For Coke Quenching Control |
| 4726465 | Kwasnik et al | Coke Quenching Car |
| 4743342 | Pollert et al | Coke Quenching Apparatus |
| 4747913 | Gerstenkorn et al | Cooling Apparatus For Granular Coke Material |
| 4772360 | Beckmann et al | Thin Wall Coke Quenching Container |
| 4802573 | Holter et al | Process For Wet Quenching Of Coke |
| 4832795 | Lorenz et al | Coke Dry Cooling Chamber |
| 4886580 | Kress et al | Dry Quenching Coke Box |
| 4997527 | Kress et al | Coke Handling and Dry Quenching Method |
| 5024730 | Colvert | Control System For Delayed Coker |

BRIEF SUMMARY OF THE INVENTION

This disclosure provides an improved method of designing and manufacturing a delayed coker drum for use in a refining process in which, as a result of refining crude oil, coke feedstock is produced. Substantially all refinery processes that produce high order hydrocarbon products, such as gasoline, diesel fuel, lubricants and so forth produce, as a by-product of the refinery process, coke feedstock. A refinery must deal with the coke feedstock, that is, treat it in such a way that it does not become an environmental hazard and in order to recover as much commercial value from the coke feedstock as possible. For these reasons, the typical refinery process includes subjecting the coke feedstock to destructive distillation to extract therefrom as much as possible of all remaining useable high order hydrocarbon products so that after the destructive distillation the coke is formed substantially of carbon. The output of destructive distillation is a hot liquid, typically about 900° F. (477.4° C.).

The typical means of dealing with coke feedstock resulting from refinery operation is, after destructive distillation, to convey the hot coke feedstock into a coker drum. A coker drum is typically an upright cylindrically walled metal vessel that may be such as 20–30 feet in diameter (6.10–9.14 meters) and up to 100 feet in elevation (30.48 meters), although the actual dimension can vary considerably. The typical coker drum is manufactured by welding together a series of metal plates to form the vessel cylindrical sidewall which is completed by upper and lower vessel structures.

The coke drum is filled with hot (about 900° F.) liquid feedstock until it is about 80 percent filled. The sidewall of the drum assumes approximate the temperature of the feedstock and accordingly thermally expand both circumferentially and laterally, that is, the internal diameter of the drum increases and the height increases. Accordingly, the internal diameter and height of a hot coke drum is greater than that of the drum when it is cold.

As the hot coke feedstock leaves the furnace and enters the drum it begins to cool. As the cooling process begins, the flow of feedstock entering the drum lays down layers of coke that, as they cool, solidify. Eventually, the drum contains a solid mass of solidified coke having a temperature slightly less than that of the temperature of the feedstock liquid as it first enters the drum.

Simultaneously with introduction of the hot feedstock liquid or, after the drum has been about 80% filled with feedstock, hot steam is injected into the drum to pass upwardly through non-solidified channels in the solidified coke to flush out any remaining hydrocarbon vapors. These vapors are exhausted out through a vent in the top of the drum.

It is now necessary to cool the coke. Obviously, the solidified coke in the drum would eventually return to ambient temperature by dissipation of heat from the insulated drum to the atmosphere but such would take an inordinate amount of time. The typical process is to accelerate cooling by quenching the solidified coke with water. Accordingly, water, at approximately ambient temperature, is injected into the bottom of the coke drum. As the water rises it cools the coke rapidly and simultaneously cools the drum sidewall. As the coke is cooled it more firmly solidifies, and as the drum cools it shrinks both circumferentially and laterally.

Shrinkage of the internal diameter and height of the vessel is resisted by coke which has solidified in close conformance to the interior expanded vessel sidewall, that is, the coke becomes solid at a temperature at which the sidewall is expanded prior to the quenching action. Therefore, when quenching water rises in the coke drum, the drum sidewall thermally contracts to apply great stress on the solidified coke. The stress applied by the vessel sidewall must function to crush the solidified coke to allow the vessel sidewall to return to at least substantially its initial internal diameter prior to heating of the drum sidewall when the coke stock was introduced into the drum as a liquid. As the drum shrinks, both circumferential (hoop) stresses and laterally (axial) stresses develop. Specifically, drum sidewall circumferential (radial) contraction is resisted by the resistance to crushing of the solidified coke and lateral contraction is resisted by the interface frictional contact between the solidified coke and the drum sidewall.

By measurements made using strain gauges, it has been determined that a predictable stresses in various portions of the drum sidewall are required to cause the solidified coke to crush and to overcome the lateral contraction interface friction. Further, tests have determined that crushing of the solidified coke and lateral frictional resistance cause predictable stresses. Therefore, it has been learned that in designing and constructing a delayed coker drum the life expectancy of the drum can be significantly increased by observing appropriate rules of design and construction.

Tests have shown that when the elastic limits of a coke drum sidewall are less than the circumferential and lateral stresses required to crush coke solidified in the drum and overcome the lateral friction that the drum sidewall stretches and permanently deforms, resulting in bulging and thinning of the sidewall and ultimate failure of the coke drum due to low cycle fatigue.

Therefore, under the principles of this invention it has been learned that to substantially increase the life expectancy of a coke drum the vessel sidewalls must be formed of metal plates having metallurgical characteristics and thickness such that the maximum stress encountered during quenching wherein solidified coke is crushed by the shrinking vessel sidewall is not substantially greater than the elastic limits of the metal plates. Increasing the elastic limits of metal plates is achieved in two ways. First, by selection of plates having desirable metallurgical characteristics that provide high elastic limits per unit volume and second, by selecting the thicknesses of metal plates in accordance with the crushing characteristics and frictional resistance of the coke to be handled. These factors, taken in conjunction with the diameter and height of the vessel permit the design and construction of a coke drum in which the maximum stress applied during quenching is not substantially greater than the elastic limits of the selected plates.

Further, tests have indicated that the characteristics of the weld seams are as important as the characteristics of the plates. That is, the weld seams must be formed using techniques and weld metal such that the weld seams have elastic limits that are not substantially exceeded during the quenching process.

A better understanding of the invention will be obtained from the following description of the preferred embodiment and the claims, taken in conjunction with the attached drawings.

DESCRIPTION OF THE DRAWINGS

FIG. 1 shows means for introducing steam into the coke drum and quenching water. FIG. 1 presupposes that as the hot fluid product, that is, the hot coke feedstock enters the vessel that the vessel wall thermally expands both circumferentially and longitudinally.

FIG. 2 shows the consequence of admitting quench water into the coke drum wherein the quench water has risen to a level slightly over one-half of the height of the coke within the drum showing, in an exaggerated way, how the coke drum sidewall shrinks as quenching water enters, the coke drum sidewall being required to crush the solidified coke while the upper portion of the coke drum sidewall remains thermally expanded at an elevated temperature prior to being cool by quench water.

DETAILED DESCRIPTION OF THE PREFERRED EMBODIMENTS

Figure 1:
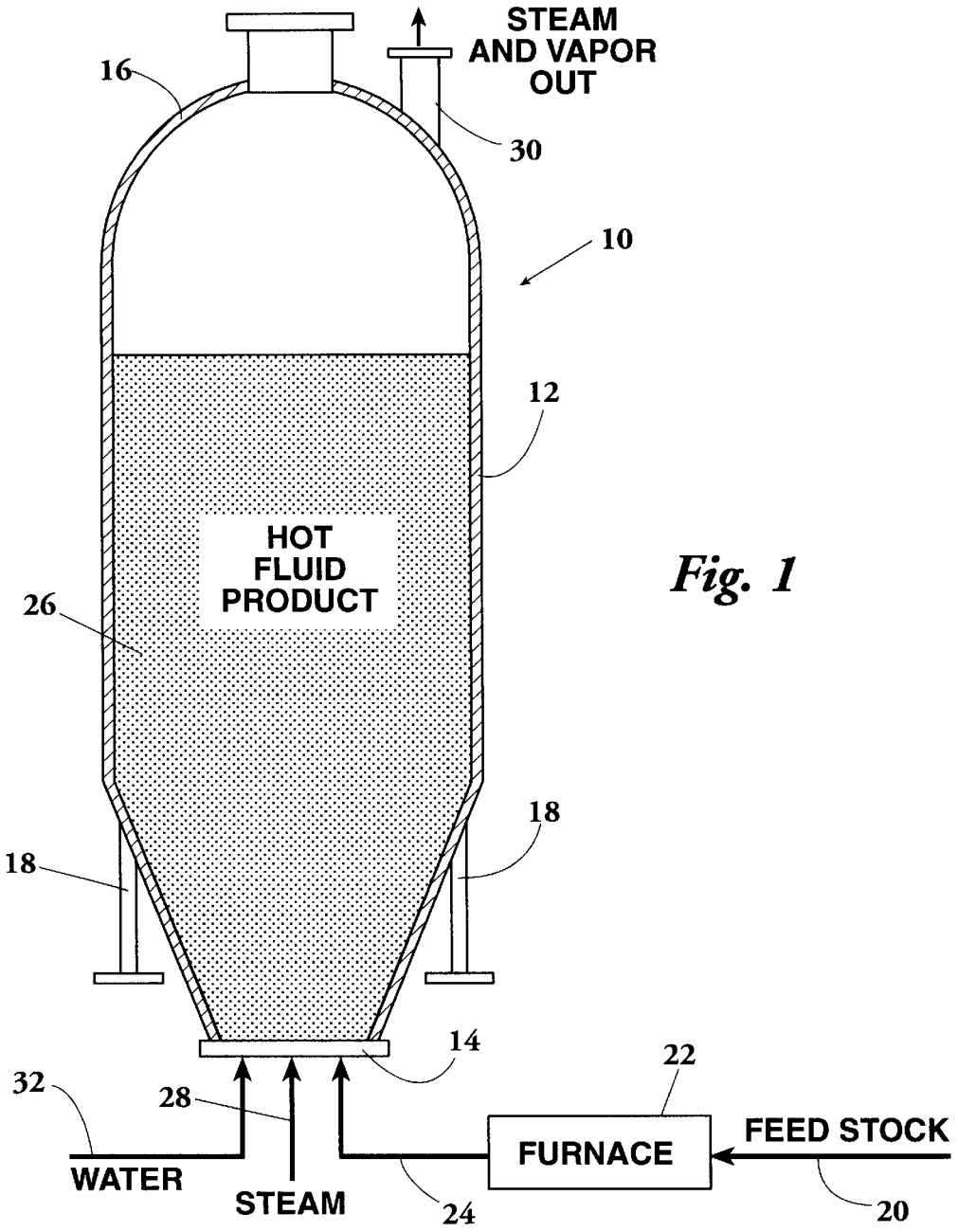
FIG. 1 is a diagrammatic elevational cross-sectional view of the coke drum showing the means of filling the coke drum with feedstock that is first passed through a furnace wherein destructive distillation occurs and by which the interior of the coke drum is filled with a hot liquid coke feedstock that begins to solidify as it enters the coke drum.

Referring to FIG. 1, a coker drum is generally indicated by the numeral 10 and is typically an upright cylindrical vessel having a sidewall 12, a bottom portion 14 and a top portion 16. The coker drum is shown with support legs 18 (that can also be a circular skirt) by which the vessel is supported on the earth's surface in a vertical upright position.

Feedstock resulting from a refinery process is conveyed to the coker drum by piping 20. The coke feedstock passes through a furnace 22 wherein it is subjected to destructive distillation, that is, to a temperature sufficient to drive out all or substantially all of the remaining hydrocarbon products. The output from furnace 22 is a hot liquid coke feedstock that flows by piping 24 into the bottom portion 14 of coker drum 10.

This hot liquid coke feedstock rises within coker drum 10 and begins to cool. FIG. 1 shows a hypothetical situation wherein the hot coke feedstock 26 has risen to a preselected level, typically about 80% of the internal volume of the vessel, and demonstrates the situation in which the vessel sidewall 12 has been heated to and attain substantially the temperature of the feedstock, which may be about 900° F. (477.4° C.).

Concurrently with feeding the hot coke feedstock through piping 24 into the vessel, or after the vessel has been filled to its prescribed capacity, steam is introduced through conduit 28. Steam flows into bottom 14 of the vessel and upwardly through remaining liquid passageways within the coke feedstock 26 to drive out any entrained hydrocarbon vapors, the steam and vapors pass out of the interior of vessel 10 through steam and vapor outlet 30. After vessel 10 has been filled with hydrocarbon feedstock to the prescribed level, it is necessary then to cool the coke feedstock to a solidified product that is near ambient temperature so as to permit the solidified product to be removed from coker drum 10 and to be safely handled and to thereby prepare coker drum 10 for subsequent use to receive additional feedstock. This process is called a "delayed coker", that is, the cooling of the coke to a solid state is a delayed step in the overall petroleum refining process. Treated coke feedstock has two basic purposes. First, some means must be provided for disposition of the coke feedstock which has a substantially reduced market value compared to the other products derived from crude oil, that is, the coke feedstock cannot be arbitrary discharged into the environment as it would accumulate and create an environmental hazard. Second, while the value of the coke by-product is less than that of most of the other derivatives of crude oil that are separated in a refining process, nevertheless, the coke has some economical value which must be recovered for an efficient refinery operation.

Accordingly, to prepare the coke, after solidification in coker drum 10, to be removed as a solid, it must be cooled to near ambient temperature. Cooling of the coke after it is received in drum 10 is accomplished by quenching. In the quenching operation water is fed through piping 32 into the vessel bottom portion 14, the water rising gradually within coker drum 10. It is important to control the rate of quenching so as to prevent undue stress being applied to the vessel wall. For improved means of controlling the rate of quenching so as to minimize damage to coke drum 10 reference may be had to co-pending United States patent application entitled "METHOD OF CONTROLLING THE QUENCH OF COKE IN A COKE DRUM", which is incorporated herein by reference.

Figure 2:
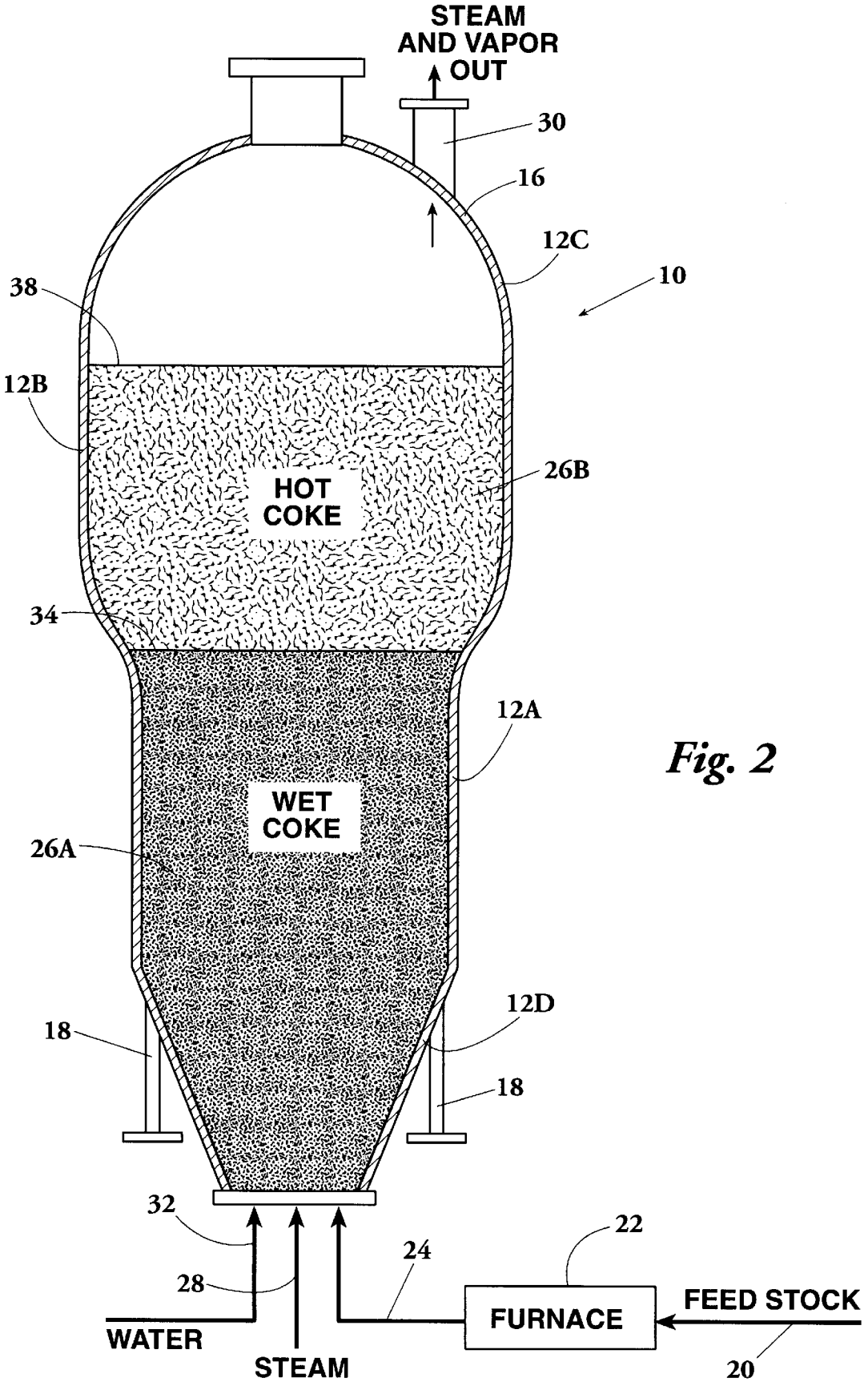
FIG. 2 shows diagrammatically (exaggerated) the consequence of quenching of solidified coke product in a coke drum. That is.

FIG. 2 diagrammatically illustrates the consequence of the quenching operation. In FIG. 2 it is presumed that the quenching water has reached a level in coke drum 10 indicated by the numeral 34. As the quench water rises in drum 10, the solidified coke is cooled, the cool solidified coke being indicated by the numeral 26A whereas the coke within the vessel that has not yet been quenched is indicated by the numeral 26B. As quenching of the coke takes place, identified as "wet coke" in FIG. 2, not only is the coke cooled but the vessel sidewall is also cooled. The cooled vessel sidewall is indicated by the numeral 12A, whereas the vessel sidewall that has not yet been cooled by the quenching water is indicated by the numeral 12B. As stated with reference to FIG. 1, when hot coke by-product is injected into vessel 10, the sidewall 12 assumes substantially the temperature of the hot product and thermally expands. When quenching water enters the vessel, as indicated in FIG. 2, the portion of the vessel contacted by the quenching water cools substantially and rather rapidly and causes the vessel sidewall to shrink circumferentially and laterally. The coke is simultaneously cooled, however, the vessel being formed of metal has a much higher coefficient of thermal expansion than coke and, therefore, the vessel sidewall contracts both circumferentially and laterally at a rate substantially greater than that of the coke. This contraction applies substantial pressure on the solidified coke 26A confined within the vessel sidewall 26B. Additionally, lateral contraction of the drum sidewall is resisted by interface friction between the solidified coke and the sidewall. If the combined pressure applied by the shrinking vessel sidewall 12A against solidified coke and the frictional drag against the vessel wall as the vessel shrinks in height are greater than the elastic limits of any portions of the vessel sidewall, then sidewall portions permanently stretch and thin. Stretching and thinning of portions of the vessel sidewall causes bulging and ultimately drum failure as a result of low cycle fatigue.

It has been discovered that in order to manufacture a coker drum 10 that will have substantially increased life, the vessel must be so constructed so that it will apply sufficient pressure to crush solidified coke and overcome lateral friction resistance as the vessel sidewall shrinks during quenching operations without substantially exceeding the elastic limits of the vessel sidewall.

Vessel sidewall 12 is typically made up of a plurality of metal plates that are welded together. Therefore, in the practice of this invention, each metal plate making up the sidewall must be selected to have a metallurgical characteristic and thickness such that the pressure and friction imposed by thermal contraction necessary to cause crushing of the solidified coke within the vessel does not exceed the elastic limit of the plate.

The elastic limits of a metal plates of which the coke sidewall is formed is determined by the metallurgical characteristic of the plate. The maximum safe crushing force that a plate can create to crush solidified coke is determined essentially by the yield strength (elastic limit) and the thickness of the plate metal. Therefore, these two characteristics are combined in the selection of metal plates for the construction of vessel sidewall 12.

Further, the coke drum sidewall 12, being formed of plates, requires that the plates be welded together forming a series of welded seams. It has been learned that the elastic limit of the welded seams must not be substantially exceeded during quenching if the coke drum is to have a long useful life.

The ultimate design of a coke drum is determined by the following factors: (a) the temperature of which the hot coke feedstock liquid enters the coke drum; (b) the crushing and friction characteristics of the coke as it solidifies, as determined by the nature of the crude oil being refined and the refining process, that is, coke when solidified crushes at different pressures; (c) the resistance to interface friction as the drum laterally shrinks in height; (d) by the diameter of the coke drum; (e) by the height of the coke drum; (f) by the desired quenching rate, that is, how rapidly must the coke be quenched; and (g) by the hydrostatic pressure in the drum during the quenching process.

Figure 3:
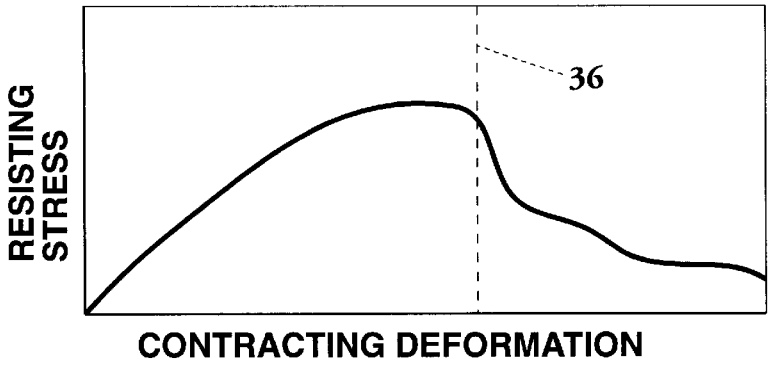
FIG. 3 is a diagram showing the resisting stress applied by solidified coke to the vessel sidewall as the ordinate and the contracting deformation as the abscissa showing that as stress is applied by the coke drum sidewall against the solidified coke, a level of stress is reached at which the coke is crushed and that, after crushing, the stress in the vessel sidewalls substantially reduces even as contraction of the vessel sidewall continues.

It has been learned that during a quenching operation, the stresses to drum thermal contraction change dramatically in comparison with contracting deformation. FIG. 3 illustrates the phenomena that as the contracting deformation increases, a resisting stress level is reached at which the coke crushes. When crushing occurs, resistance to further contracting deformation suddenly decreases as indicated by dotted line 36 on the chart of FIG. 3. In designing and manufacturing a coke drum according to this invention, the metallurgical characteristics of the plates and welding seams of the vessel sidewall are preferentially selected so that the elastic limit of any portion of the vessel sidewall will not be exceeded when the contracting deformation rises at least to the level reached at dotted line 36.

All areas of sidewall 12 of coker drum 10 are not subjected to the same stresses and therefore the characteristics and thicknesses of the plates and the characteristics of the welding seams can vary according to their location in the drum sidewall. For instance, the vessel sidewall 12C that is above the maximum coke level 38 as seen in FIG. 2 are not subjected to the stresses of the coke drum sidewall below the elevation indicated by line 38. Accordingly, the thickness and characteristic requirements of the plates and welding seams making up the portion 12C of the vessel sidewall may be reduced.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A method of designing a delayed coker drum in which coke feedstock derived from the refining of petroleum crude to produce higher order hydrocarbon products, is, after destructive distillation, feed at a high temperature into the drum causing the drum to thermally expand circumferentially and laterally after which the coke solidifies into frangible solid coke and is quenched to reduce the temperature of the solidified coke to permit the coke to be extracted from the drum as a solid at near ambient temperature, and in which the drum shrinks circumferentially and laterally as the temperature of the drum is reduced by the quenching step, the circumferential shrinking resulting in crushing the solidified coke and the lateral shrinking resulting in interface frictional resistance between the solidified coke and the drum, comprising the steps of:

(a) determining the resistance to crushing of the coke as solidified and the interface frictional resistance between the drum and the solidified coke;

(b) calculating the thermal circumferential and lateral expansion of the drum prior to quenching of the coke;

(c) from the results of steps (a) and (b) and the selected dimensions of the drum, determining the stress per unit area of the drum due to: (a) crushing the solidified coke at the determined temperature of the drum when crushing occurs and (b) the interface frictional resistance between the drum and the solidified coke during quenching of the coke; and (d) select metal plates of shapes and dimensioned so that when welded together a coker drum is formed, each plate having a thickness and elasticity so that stresses in all areas of the drum during crushing of the coke and lateral shrinkage does not exceed the elastic limit of any plate.

2. A method of designing a delayed coker drum according to claim 1 including the additional steps of:

(e) determining the pressure within the drum when crushing of the coke occurs; and (f) employing the determined pressure from step (e) in step (c) to determine the stress per unit area of the drum.

3. A method of designing a delayed coker drum according to claim 1 wherein the drum is shaped as a vertical cylinder and wherein steps (a) through (d) are undertaken for different selected elevational portions of the drum.

4. A method of designing a delayed coker drum according to claim 1 in which the drum is shaped as a vertical cylinder and said metal plates are joined by welded seams and wherein steps (a) through (d) are additionally applied to select the welding procedures and materials for said welded seams.

5. A method of manufacturing a delayed coker drum used in a refining process in which, as a result of refining crude oil to produce higher order hydrocarbon products, coke feedstock results as a by-product, which by-product is subjected to destructive distillation producing a hot liquid coke feedstock which thereafter must be converted in the coker drum to a solid coke product and cooled to substantially ambient temperature for subsequent disposition, the coker drum being a cylindrical upright metal vessel that thermally expands circumferentially and laterally when hot liquid coke feedstock is received therein and which shrinks circumferentially and laterally when water is fed into the drum to quench the coke therein, the circumferential shrinkage of the drum causing coke solidified therein to be crushed thereby subjecting the drum to circumferential stress and the lateral shrinkage of the drum causing the drum to encounter lateral stress as a consequence of interface frictional resistance between the drum and the solidified coke, comprising:

selecting a plurality of metal plates configured for assembly into a cylindrical, upright coker drum;

welding the metal plates together creating welded seams to form the cylindrical sidewall of a coker drum, said metal plates being selected to have elastic characteristics and thicknesses such that stresses introduced in the plates as said drum circumferentially and laterally shrinks resulting in the crushing of solidified coke within the drum and overcoming lateral interface frictional resistance are such that the elastic limits of the plates are not exceeded and wherein the step of welding employs the use of welding metals and techniques such that the stresses introduced in the welded seams as the drum circumferentially and laterally shrinks does not exceed the elastic limits of the welded seams.

6. A method of manufacturing a delayed coker drum according to claim 5 including the additional steps of determining the pressure within the drum when crushing of the coke due to circumferential shrinkage occurs and lateral interface frictional resistance is overcome and employing the determined pressure in selecting the elastic characteristics and thickness of the metal plates and determining the welding metal and techniques for the welded seams.

7. A method of manufacturing a delayed coker drum according to claim 5 wherein the drum is shaped as a vertical cylinder and wherein different metal plates and welded seam characteristics are selected for different selected elevational portions of the drum.

8. A coker drum for use in a refining process in which, as a result of refining crude oil to produce higher order hydrocarbon products, coke feedstock results as a by-product, which by-product is subjected to destruction distillation producing hot liquid product which thereafter is converted in the coker drum to a solid coke product and cooled to a substantially ambient temperature for subsequent distribution, the coker drum thermally expanding circumferentially and laterally when hot liquid coke feedstock is received therein and thermally contracts circumferentially and laterally when quenching fluid is introduced into the drum to quench the coke therein, which circumferential contraction causes coke solidified within the drum to crush and which lateral contraction causes the drum to encounter and overcome interface frictional resistance, the coker drum comprising:

a bottom end portion;

a top end portion; and an elongated upright cylindrical sidewall extending between and secured to said bottom and top end portion, said sidewall being formed of a plurality of metal plates having edges that are welded together forming welded seams, the metal plates and welded seams each having elastic characteristics and thickness so that stress introduced in each of the plates and each of the welded seams as the drum sidewall contracts circumferentially and laterally to cause crushing of solid coke within the drum and overcoming interface frictional resistance between the sidewall and solidified coke does not exceed their elastic limits.

9. A coker drum according to claim 8 wherein the drum is subjected to internal hydrostatic pressure during the process of quenching coke, and wherein said metal plates and welded seams each have elastic characteristics and thicknesses such that the stress introduced in each of the plates and each of the welded seams due to crushing of solid coke within the drum as the drum thermally shrinks during a quenching function and the stress of overcoming the frictional resistance between the solidified coke and the drum sidewall plus the internal hydrostatic pressure during a quenching operation does not exceed the elastic limit of any of the plates or any of the welded seams.

* * * * *